United States Patent [19]

Cagnassi

[11] 4,244,739

[45] Jan. 13, 1981

[54] CATALYTIC SOLUTION FOR THE ELECTROLESS DEPOSITION OF METALS

[76] Inventor: Roberto Cagnassi, 98 via Ventimiglia, I-10126 Torino, Italy

[21] Appl. No.: 56,398

[22] Filed: Jul. 10, 1979

[30] Foreign Application Priority Data

Jul. 25, 1978 [IT] Italy ..... 68768 A/78

[51] Int. Cl.[3] ..... B01J 31/02; C25D 3/52; C23C 3/02; B05D 3/10

[52] U.S. Cl. ..... 106/1.11; 204/30; 252/428; 252/429 A; 252/431 R; 427/304

[58] Field of Search ..... 106/1.11; 427/304; 204/20, 30; 252/431 R, 428, 429 A, 429 B

[56] References Cited

U.S. PATENT DOCUMENTS 3,650,913 3/1972 D'Attavio ..... 204/30
3,682,671 8/1972 Zeblisky ..... 204/30
3,874,882 4/1975 Gulla et al. ..... 106/1.11

FOREIGN PATENT DOCUMENTS 929800 6/1963 United Kingdom .

OTHER PUBLICATIONS

*Plating*—Jun. 1973 pp. 611-616 "Reliability in Printed Circuitry Metalization—A Case for Improved Catalyzing Systems" by N. Feldstein.

*Primary Examiner*—P. E. Konopka
*Attorney, Agent, or Firm*—Young & Thompson

[57] ABSTRACT

A catalytic solution for electroless deposition of metals, wherein at least a part of the acid, contained therein along with a soluble salt of a noble metal and a soluble salt of a metal of group IB or VIII of the periodic system, is an aliphatic sulphonic acid capable of forming stable and catalytically active complexes, such as methane-sulphonic acid.

31 Claims, 1 Drawing Figure

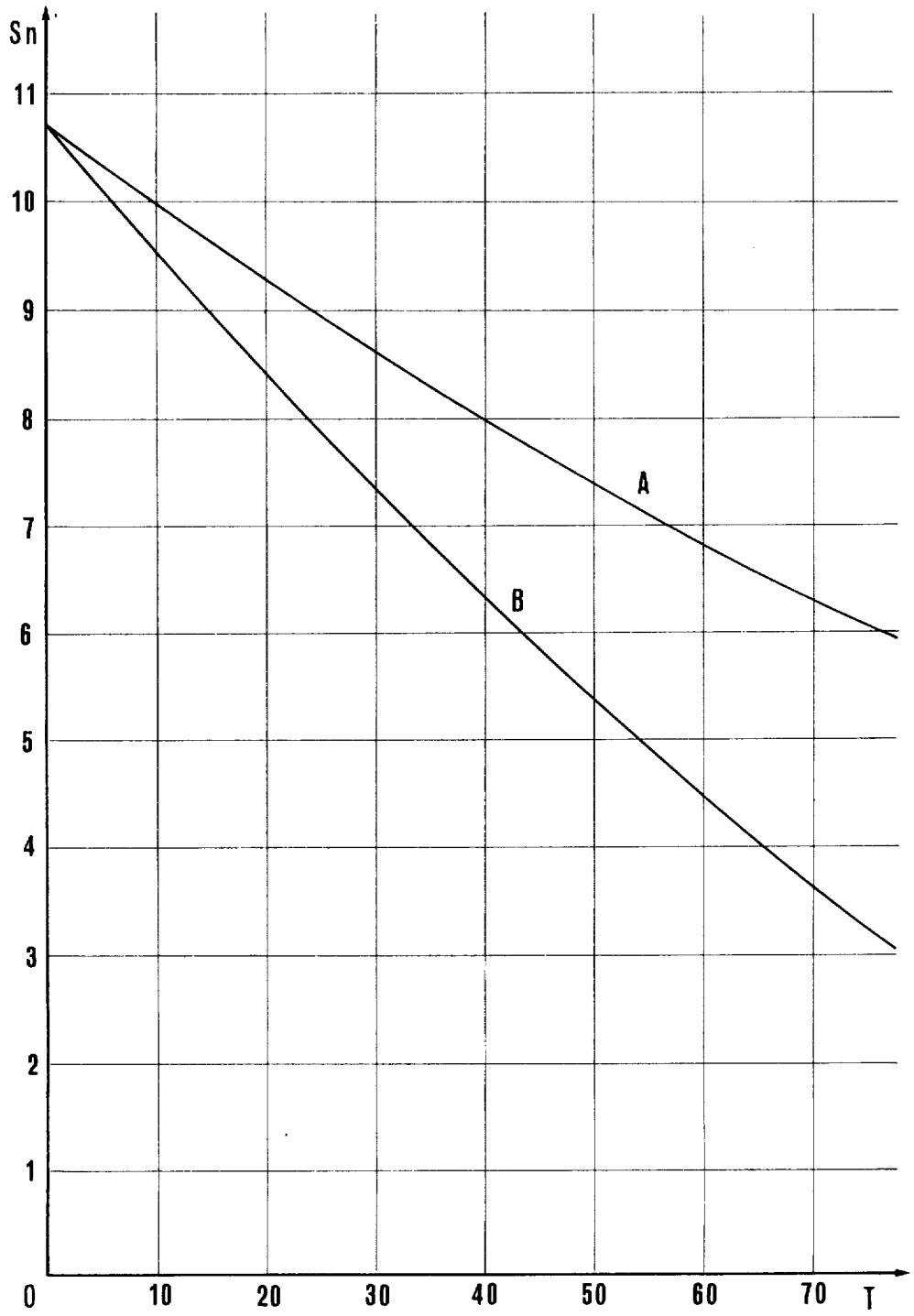
Sn
11
10
9
8
7
6
5
4
3
2
1
0
10
20
30
40
50
60
70
T
A
B

CATALYTIC SOLUTION FOR THE ELECTROLESS DEPOSITION OF METALS

BACKGROUND OF THE INVENTION

The present invention relates to the formulation of aqueous catalytic solutions intended to activate non-conductive surfaces and to allow subsequent electroless deposition of metals, and more particularly the formulation of solutions containing one or more noble metals capable of rendering catalytically active a non-metallic surface with respect to the solutions for the electroless deposition of metals such as copper, nickel, cobalt, and alloys thereof.

Electroless metallization is mainly practised on surfaces of non-conductive materials, such as plastics, glass and ceramic, and has a particular importance in the industry of ornamental articles and, in the electronic industry, for the manufacturing of printed circuits with through holes.

A method of activation hitherto used comprises a step of catalyzation of the non-conductive surfaces, in which the surface to be metallized is made to adsorb active catalytic nuclei which are adapted to produce, when the piece is immersed in the subsequent suitable solution, the reaction of electroless deposition of a thin conductive metal layer suitable for allowing the successive step of electrolitic deposition.

All noble metals, both of the gold group and of the platinum group, can produce activating solutions; at the present time, however, the noble metal which is mostly used in the industry as a catalyst is palladium.

By utilizing this metal, the process of activation can be carried out according to two methods: according to the first method, the articles to be metallized, whose surface has been suitably cleaned and treated, are immersed first in a solution, acidic because of the presence of hydrochloric acid, containing stannous chloride, and then, after a thorough washing, in a solution, also acidic due to the presence of hydrochloric acid, containing palladium chloride.

This method gives rise to considerable disadvantages, both because of the poor stability of the solutions and of the poor adherence between the metal deposit and the support. This latter is an extremely serious disadvantage, in particular in the production of electric through-hole printed circuits, where often the plastic support is coated with a thin copper lamina on one or both sides. In fact, in the presence of copper surfaces, the acid solution containing the noble metal deposits, by chemical displacement, a non-adherent layer of noble metal, which needs to be mechanically removed from the surface of copper laminate, thus giving rise to a considerable increase in the cost of production and rendering practically impossible the practice of automated processes.

The second method, according to the known techniques, consists in catalyzing a non-conductive or partially conductive material (as in the case of the laminates for printed circuits) in a single-step catalytic solution resulting from the mixture and the respective products of reaction between the three components which so far have been deemed to be basic for obtaining catalytic solutions which are sufficiently active and stable even after many weeks, by avoiding the formation of precipitates or crystallization; such components are hydrochloric acid, stannous chloride and palladium chloride.

Although it is possible, theoretically, to use other soluble palladium and tin salts, preference has always been given to the use of halides, such as palladium chloride and stannous chloride, since the presence of chloride ions at high concentration has always been deemed to be irreplaceable and essential. Although also other halogenic acids may be used, hydrochloric acid is preferred.

It should also be noted that not only the presence of hydrochloric acid (HCl) at high molar concentration has always been considered as fundamental for attaining active catalysts stable during their preparation, but it has always been considered as indispensable for such acid to be present also, at a high concentration, in the solutions which are subsequently diluted, to allow their industrial utilization. In fact, a low concentration of mineral halogenic acid gives rise to instability of the system, with the consequent loss of catalytic activity and precipitation or crystallization of the components of the mixture.

The resulting need of operating, even in the diluted phase, with aqueous solutions containing 20–30% by volume of hydrochloric acid, has always been the cause of very serious disadvantages as regards both the plants and equipments and, especially, the health of the operators, owing to the continuous formation, in the working rooms, of fumes which are highly corrosive and detrimental to the respiratory organs. Even if, according to recent studies of some authors, the concentration of free hydrochloric acid may be considerably reduced, in the dilution step for industrial purposes, by utilizing other sources of chloride ions ($Cl^-$), such as for example the chlorides of the alkali metals, nevertheless, high concentrations of the mineral halogenic acid are always been deemed indispensable in the preparation of the concentrated catalyst. Moreover said technique, which has been introduced recently, has some practical disadvantages, such as an extremely high saline concentration (near to saturation point) of the industrially used solutions with a low concentration of noble metal, a lower stability of the system, with the consequent tendency to the formation of precipitates, and the poor industrial practicability of the operation of dissolving large quantities of a solid salt. Examples of the proposals mentioned hereinabove are described in U.S. Pat. No. 3,874,882 and the article by Feldstein in the review "Plating", June 1973, 60–611 (1973).

BRIEF SUMMARY OF THE INVENTION

It is the object of the present invention to provide a new solution, catalytically very active and extremely stable both at a low and at a high concentration of noble metal, which avoids the considerable disadvantages of the solutions presently utilized having a high concentration either of hydrochloric acid or of chloride ions.

The catalytically active solutions according to the present invention substantially comprise the products of the mixing and reaction of the following main components in aqueous solution:

1. A soluble salt of a noble metal of group IB or group VIII of the periodic system;
2. A soluble salt of a metal of group IV of the periodic system;
3. An aliphatic sulphonic acid capable of forming stable and catalytically active complexes with the metals mentioned hereinabove, said acid having the general formula $RSO_3H$, where R is a linear or branched aliphatic group containing, or not, one or more double bonds, and containing from 1 to 6 carbon atoms.

More particularly, as regards point 1, although any noble metal salt may be used, known in the literature as being adapted to carry out a catalytic action in the subsequent step of electroless deposition of metals, such as for example copper, nickel and cobalt, nevertheless the palladium salts are the most commonly used and therefore they are a preferred component also for the purposes of the present invention. Although it is possible to utilize both organic and inorganic soluble salts of palladium, such as for example hydrates, halides, nitrates, fluoborates and acetates, the methane-sulphonated palladium $(CH_3SO_3)_2Pd$ is the preferred salt.

As regards point 2, both organic and inorganic soluble stannous salts, such as for example halides, nitrates, acetates, and preferably stannous methane-sulphonate $(CH_3SO_3)_2Sn$ may be utilized.

As regards point 3, aliphatic sulphonic acids containing one or more sulphonic groups bound to a linear or branched aliphatic radical containing, or not, one or more double bonds may be used; in particular, for the purposes of the present invention, methane-sulphonic acid $(CH_3SO_3H)$ has been advantageously utilized.

The concentration of the noble metal may vary from 1 to 50 g/l in the concentrated catalytic solutions used for the subsequent preparation by dilution of baths ready for use at a low concentration of noble metal, and for their periodic renewal, and from 0.001 to 1 g/l in the baths ready for use which are utilized industrially for the electroless deposition of metals.

The concentration of bivalent tin may vary, in the concentrated catalytic solutions, from 10 g/l to its limit of solubility, and more particularly from 50 to 600 g/l; and it may vary from 1 to 100 g/l, preferably from 2 to 50 g/l, in the diluted solution ready for use.

More important than the concentrations of the various components of the catalytic mixture are their concentration ratios, both in the solutions with a high content of noble metals and in those with a low content of such metals.

The molar concentration of the stannous ions must always be kept in excess with respect to the molar concentration of the ions of the noble metal; the ratio may vary between 5:1 and 100:1. In practice, the molar ratio may be in the range 10:1 and 60:1. A molar excess of the stannous ions, with respect to noble metals being used, is indispensable for the stability of the solutions and for compensating eventual losses of stannous ions due to their slow air oxidation, which takes place during the utilization of diluted catalytic solutions.

DETAILED DESCRIPTION OF THE PREFERRED EMBODIMENTS

Of main importance, for the purposes of the present invention, in respect of the techniques which have been utilized till now, is the use of an aliphatic sulphonic acid, and in particular, for example, methane-sulphonic acid, as a substitute for both the hydrochloric acid and the external sources of chloride ions, which were indispensable according to the techniques known till now; as external sources of chloride ions being meant the addition of alkali halides, such as for example, lithium chloride, sodium chloride or potassium chloride, except, therefore, the halides which are already present in the acid salt of the noble metal and in the stannous salt.

The use of an aliphatic sulphonic acid (such as methane-sulphonic acid), of its salts and its homologues has a fundamental importance for the purposes of the present invention, inasmuch as it is possible, in certain embodiments, to advantageously substitute not only the halogenic acid used in the prior art techniques (hydrochloric acid) and the external sources of halide ions (chlorides) utilized in the more recent techniques in the dilution step, but also all the sources of halide ions which may originate from the anions of the noble metal salts utilized and from the stannous salt.

Starting from suitable salts of palladium and stannous salts, such as for example the hydroxides, it is possible, for example, to prepare concentrated solutions both of methane-sulphonate palladium and stannous methane-sulphonate, by using a molar excess of methane-sulphonic acid in aqueous solution. These concentrated solutions may readily be utilized for the preparation of catalytically active mixtures, thereby avoiding all the disadvantages mentioned hereinabove deriving from the use of solutions with either high content of halogenic mineral acids (such as hydrochloric acid), or a low content of hydrochloric acid and a high content of alkali metal halides.

It should be noted, on the other hand, that there is no incompatibility between the aliphatic sulphonic acids (such as methane-sulphonic acid) and the halogenic acids (such as hydrochloric acid), so that the complete elimination of the halide ions from the solution ready for use represents a possibility afforded by the invention but not a necessity. On the contrary, for both economical and other reasons, it may sometimes be convenient to systematically provide for the presence of halide ions, generally chlorine ions, in the solution ready for use.

For example, the final presence of chlorine ions may derive from the use of palladium chloride and/or stannous chloride in the preparation of the concentrated solution, which use allows obtaining a reduction of the costs.

According to another example it is possible to use, as the concentrated solution, a substantially conventional solution as to hydrochloric acid, by converting it into a solution according to the present invention only at the moment of its dilution for the preparation of the solutions ready for use, utilizing for the dilution a solution of aliphatic sulphonic acid, particularly methane-sulphonic acid, instead of a solution of hydrochloric acid or sodium chloride. Although, obviously, by operating in this way one foregoes full exploitation of the advantages afforded by the invention, in particular the advantage of using concentrated solutions free from hydrochloric acid, however, also in this case one obtains the considerable advantage of having a solution ready for use which contains little hydrochloric acid, and, in addition, the operational advantage of not having to use, when carrying out the operation of dilution, either hydrochloric acid, with the dangers involved, or sodium chloride, with the inherent difficulties of dissolution, but only methane-sulphonic acid, which can be supplied in solution in highly concentrated form and, consequently, without difficulty of dilution and, at the same time, with minimum encumbrance problems as to transportation and storage.

Thus, the present invention is suitable for a large variety of applications, from the just mentioned case of minimum encumbrance to the even total removal of the halide ions from the solution ready for use. In view of the particular convenience to use, as the aliphatic sulphonic acid, methane-sulphonic acid, this latter will be referred to in the following, it being however understood that it may be replaced by another aliphatic sulphonic acid.

The objects of the present invention do not comprise the techniques of preparation of the single initial concentrated solutions to be utilized for the preparation of both the concentrated catalytic solutions and the catalytic solutions having a low content of noble metal, utilized industrially, which latter, of course, may be prepared by simple dilution from the concentrated catalytic solutions, according to the preparational techniques which will be described later. As single initial concentrated solutions are intended the following:

1. A solution of a methane-sulphonate of a catalytically active noble metal for the electroless deposition of metals, such as for example a solution of methane-sulphonate palladium in simple aqueous solution or in a solution rendered acid by the presence of methane-sulphonic acid. The concentration of the noble metal may vary from 1 g/l to its limit of solubility. The concentration of free methane-sulphonic acid may vary from 0 in the case of a simple aqueous solution of methane-sulphonate palladium, to the limit of solubility of the methane-sulphonic acid.
2. A solution of methane-sulphonate of a metal of the group IV, such as for example stannous methane-sulphonate, in solution rendered acid due to the presence of methane-sulphonic acid. The concentration of the metal may vary from 10 g/l to the limit of solubility of the stannous salt in a solution acid due to the presence of methane-sulphonic acid. The concentration of the free methane-sulphonic acid may vary from 10 g/l to the limit of solubility.

For the preparation of solutions having a high concentration of the noble metal, and for the dilution of these concentrated solutions in order to obtain solutions catalytically active and stable even at low concentration of the noble metal, in view of the respective industrial applications, for example the following procedures may be used.

EXAMPLE 1

By utilizing a solution (1) of an acid salt of a noble metal having the following composition:

| | | |
|---|---|---|
| Solution (1) | Methane-sulphonate palladium $(CH_3SO_3)Pd$ | 1M |
| | Methane-sulphonic acid $CH_3SO_3H$ | 1M |

and a solution (2) of an acid salt of a metal of group IV having the following composition:

| | | |
|---|---|---|
| Solution (2) | Stannous methane-sulphonate $(CH_3SO_3)Sn$ | 2M |
| | Methane-sulphonic acid $CH_3SO_3H$ | 3M |

a catalytically active solution is prepared according to the following procedure:

One liter of solution (2) is heated to the boiling point, and 50 ml of solution (1) are slowly added under vigorous stirring. The thus-obtained mixture is kept at the boiling temperature for 15 minutes, and then it is allowed to cool to ambient temperature, still keeping the mixture under stirring. Thus, a catalytically active solution for the electroless deposition of metals is obtained, which has the following composition:

$Pd^{++}$: 5.06 g/l
$Sn^{++}$: 226.05 g/l
Free methane-sulphonic acid: 279.16 g/l
Total $CH_3SO_3^-$: 647.58 g/l
Chlorides ($Cl^-$): missing

EXAMPLE 2

A solution (3) is prepared by utilizing, as acid salt of a noble metal, palladium chloride ($PdCl_2$). The solution will have the following composition:

| | | |
|---|---|---|
| Solution (3) | Palladium chloride $(PdCl_2)$ | 1M |
| | Methane-sulphonic acid $(CH_3SO_3H)$ | 1M |

1 liter of the solution according to composition (2) is made to boil, and then 50 ml of solution (3) are slowly added, keeping the solution under vigorous stirring. The thus-obtained mixture is maintained at the boiling temperature for 15 minutes, and then it is allowed to tool to ambient temperature, still keeping it under stirring. A catalytically active and stable solution is thus obtained, which has the following composition:

$Pd^{++}$: 5.06 g/l
$Sn^{++}$: 226.09 g/l
Free methane-sulphonic acid: 279.16 g/l
Total chlorides ($Cl^-$): 3.37 g/l
Total $CH_3SO_3^-$: 638.53 g/l

EXAMPLE 3

A solution (4) is prepared by utilizing, as acid salt of a metal of group IV, stannous chloride ($SnCl_2$). The solution will have the following composition:

| | | |
|---|---|---|
| Solution (4) | Stannous chloride | 2M |
| | Methane-sulphonic acid | 3M |

1 liter of solution (4) is heated to the boiling point and then 50 ml of solution (3) are slowly added, by keeping the solution under stirring. The thus-obtained solution is maintained at the boiling point for 15 minutes and then allowed to cool to ambient temperature, still maintaining the mixture under stirring. A catalytically active and stable solution is thus obtained, which has the following composition:

$Pd^{++}$: 5.06 g/l
$Sn^{++}$: 226.09 g/l
Free methane sulphonic acid: 279.16 g/l
Total chlorides ($Cl^-$): 138.44 g/l
Total $CH_3SO_3^-$: 276.23 g/l The concentrated catalytic solutions of Examples 1, 2 and 3 are used to prepare catalytic solutions with low content of noble metal which are industrially used for the electroless deposition of metals, as follows:

(A) to 1 liter of an aqueous solution of methane-sulphonic acid 3 M, 40 ml of the concentrated catalytic solution prepared as described in Example 1 are added slowly and under stirring. The resulting solution will have the following composition:

| | | |
|---|---|---|
| Solution A | $Pd^{++}$ | 0.19 g/l |
| | $Sn^{++}$ | 8.69 g/l |
| | Free methane sulphonic acid | 287.96 g/l |

-continued

| | |
|---|---|
| Total $CH_3SO_3^-$ | 299.22 g/l |
| Chlorides ($Cl^-$) | missing |

(B) To 1 liter of aqueous solution of methane-sulphonic acid 3 M, 40 ml of the catalytic solution concentrated as in Example 2 are added slowly and under stirring. The resulting solution will have the following composition:

| | | |
|---|---|---|
| | $Pd^{++}$ | 0.19 g/l |
| | $Sn^{++}$ | 8.69 g/l |
| Solution B | Free methane-sulphonic acid | 287.96 g/l |
| | Total $CH_3SO_3^-$ | 298.88 g/l |
| | Total chlorides ($Cl^-$) | 0.13 g/l |

(C) to 1 liter of aqueous solution of methane-sulphonic acid 3 M, 40 ml of the catalytic solution concentrated as in Example 3 are added slowly and with stirring. The resulting solution will have the following composition:

| | | |
|---|---|---|
| | $Pd^{++}$ | 0.19 g/l |
| | $Sn^{++}$ | 8.69 g/l |
| Solution C | Free methane-sulphonic acid | 287.96 g/l |
| | $CH_3SO_3^-$ | 284.94 g/l |
| | Total chlorides ($Cl^-$) | 5.32 g/l |

To facilitate a comparison, the composition of the solutions under consideration are shown in the following Table:

| g/l | $Pd^{++}$ | $Sn^{++}$ | Free $CH_3SO_3H$ | Total $CH_3SO_3^-$ | Chlorides ($Cl^-$) |
|---|---|---|---|---|---|
| Solution A | 0.19 | 8.69 | 287.29 | 299.22 | missing |
| Solution B | 0.19 | 8.69 | 287.36 | 298.88 | 0.13 |
| Solution C | 0.19 | 8.69 | 287.96 | 284.94 | 5.32 |

The aforementioned methods of preparation of catalytically active and stable solutions having a high content of noble metals are not limitative; in fact, it is possible to obtain solutions, active and stable, for the electroless deposition of metals, by simply mixing, even at ambient temperatures, the three main components, provided that predetermined molar ratios are complied with.

If a stoichiometric excess of the stannous ions with respect to the noble metal and a concentration of methanesulphonic acid sufficient to ensure the stabilty of the solution are maintained, by mixing the three main components in any desired succession a solution catalytically inactive for electroless deposition is first obtained, which is characterized by a dark green colour which in the long run becomes dark brown; at this point the mixture is catalytically active and stable and can be used for the electroless deposition of metals.

The heating of the mixture accelerates the natural transformation process which is indispensable for obtaining a catalytically active and stable solution. The solutions obtained in this way are stable with time and exceptionally active for the subsequent electroless deposition of conductive metals.

The high catalytic activity of the solution according to the invention allows the industrial application of the solution at a low content of noble metals, with considerable economical advantages, inasmuch as the losses of noble metals by removal are remarkably reduced.

The presence of an aliphatic sulphonic acid, such as for example methane-sulphonic acid, ensures a sufficient limitation of the air oxidation of the bivalent tin in tetravalent tin. This important function of the aliphatic sulphonic acids, as compared to the solutions having a high concentration of hydrochloric acid, eliminates the need of introducing into the catalytic mixture specific organic additives intended to reduce the oxidation of the bivalent tin, such as for example hydroquinone or cresolsulphonic acid.

In order to verify this property of the aliphatic sulphonic acids, particularly represented by methanesulphonic acid, tests of accelerated oxidation have been carried out on solutions: (A) of methane-sulphonic acid and (B) of hydrochloric acid, both of which have the same molar concentration (3.59 M) and contain a stannous salt which, due to oxidation, tends to convert into a stannic salt. It is just this transformation that progressively reduces the catalytic activity of the solutions and has to be counteracted.

By blowing in air there has been obtained in acceleration of the natural phenomenon of oxidation which practically takes place during the industrial utilization of the catalytically active solutions. The residual content of stannous ions has been measured from time to time for either solution, and the results obtained are expressed by the corresponding characteristic curves (A) and (B) of the annexed diagram, wherein the times T are expressed in hours and the content of stannous ions Sn is expressed in g/l. As can be seen, the loss of stannous ions from solution (A) containing methane-sulphonic acid is considerably smaller than the loss of stannous ions from solution (B) containing hydrochloric acid at the same molar concentration.

This, in addition to causing a higher stability of the solutions, allows one to reduce the concentration of stannous ions in the concentrated solutions used for the preparation of the baths and for their periodic replenishment, with practical and economical advantages.

The limited tendency to oxidation of the bivalent tin into tetravalent tin, caused by the presence of the aliphatic sulphonic acid, allows one also to have a lower initial concentration of stannous salt relative to the concentration of the noble metal, thus allowing a higher total concentration of the concentrated catalytic mixture used for periodically re-filling the mixture which has been diluted previously; in this way, the losses of diluted solution during the periodic replenishment intended to maintain always at the initial level the concentration of the noble metal, are drastically reduced.

The utilization of aliphatic sulphonic acids, such as methane-sulphonic acid, to substitute for the mineral halogenic acids which were used in the past, allows one to eliminate all the problems of toxicity connected therewith, as well as the presence, during the work, of troublesome and irritating fumes, with considerable advantages for both the health of the users and the safeguarding of the production plants and equipment. A particular benefit is derived especially for all the components made of stainless steel, such as for example the piece holding frames, which are extremely corrodable when in contact with substances containing chlorides, and particularly in a medium which is rendered highly acid by the presence of hydrochloric acid and which is at a high temperature.

For the sake of illustration, some non limiting examples of industrial application of the present invention will now be cited: a specific example is the use of catalytic solutions according to the invention for the metallization of the through holes in support materials, of copper and resin laminates, used for the manufacturing of electric printed circuits.

EXAMPLE 4

The tests are carried out on a suitably perforated laminate formed by an insulating support made of epoxy resin and reinforced with stratified fiber glass, on each of the two faces of which a sheet of electrolytic copper of 35 micron thickness has been glued and hot pressed. The following cycle is followed:

1. Degreasing of the laminate by means of solvents or by immersion in hot (60° C.) alkali detergent solutions, such as for example Caprolite OH 1204, followed by a subsequent washing in flowing water.
2. Mordanting of the copper of the laminate by immersion in a solution of ammonium persulphate at 200 g/l at ambient temperature for 3 minutes; subsequent washing in flowing water.
3. Acid activation of the copper and the laminate in a 10. methane-sulphonic acid solution in distilled water.
4. Immersion of the perforated laminated laminate in the catalytic solution A at 25° C. for 3 minutes, with subsequent washing in flowing water.
5. Activation by immersion in a 5% solution of fluoboric acid at 25° C. for 3 minutes, then washing in flowing water.
6. Immersion of the thus treated laminate in a solution for chemical copper plating having the following composition:
   Pentahydrated copper sulphate ($CuSO_4.5H_2O$): 12 g/l
   Seignette salt (potassium sodium tartrate): 25 g/l
   Formaldehyde solution 40% p/v ($H_2CO$): 25 ml/l
   Sodium hydroxide (NaOH): 12 g/l
   pH of the solution (at 25° C.): 12.7
   Utilization temperature: 25° C.
   Immersion time: 25 min.

After 15 minutes immersion both the surface of the laminate and the interior of the holes, as well as the edge of the pieces, are uniformly coated with a thin deposit of adhered copper which is capable, at any point on it, of conducting electric current.

7. Activation and pickling in sulphuric acid in a 10% aqueous solution.
8. Immersion of the pieces into an electrolytic copper plating bath having the following composition:
   Pentahydrated copper sulphate ($CuSO_4.5H_2O$): 100 g/l
   Sulphuric acid 96% ($H_2SO_4$): 200 g/l
   Distilled water: by volume
   Chlorides ($Cl^-$): 50 ppm
   Current density: 2 A/dm$^2$
   Immersion time: 30 min.
   Stirring: by air
9. Washing in flowing water.
10. Hot air drying.

The pieces appear uniformly coated with adhered copper, both on the surface and inside the through holes, as well as on the edges.

EXAMPLE 5

The process according to the Example 4 is carried out again by utilizing the solution B as the catalytically active solution for electroless deposition. Also in this case a uniform and adherent coating is obtained both on the surfaces of the laminate and inside the through holes, as well as on the edges of the pieces.

EXAMPLE 6

The process according to Example 4 is carried out again by utilizing the solution C as the catalytically active solution for electroless deposition. Also in this case, a uniform and adherent coating is obtained both on the surfaces of the laminate and inside the through holes, as well as on the edges of the pieces.

EXAMPLES 7, 8 and 9

The processes according to Examples 4, 5 and 6 are carried out again, varying only the duration of the immersion into the three catalytic mixtures, and namely using treatment times of 2, 5 and 10 minutes, respectively. In all cases a uniform and adherent deposit of copper is obtained both on the surfaces of the laminate and inside the through holes.

EXAMPLE 10

The tests are carried out by utilizing as the base material a plastic laminate of paper impregnated with phenolic resins, which laminate has previously been perforated by hot punching, suitably pre-treated and mordanted in a dilute sulpho-chromic mixture. The test plates are immersed for the catalysis in the solutions A, B, and C, respectively, for 2 minutes at ambient temperature. Subsequently they are washed and activated by immersion in a 5% fluoboric acid solution for 4 minutes at 25° C. After having been washed in flowing water, the plates are immersed in a solution for the electroless deposition of copper, as described hereinabove, in order to render uniformly conductive the surfaces and the through holes for the successive electrolytic deposition of copper. Also in this case a uniform and adherent coating is obtained; the adhesion between the copper deposit and the plastic base material depends upon the pretreatments utilized.

EXAMPLE 11

Three plates of acrylonitrile-butadiene-styrene (ABS), after having been thoroughly degreased, mordanted in a sulpho-chromic mixture at 65° C. for 10 minutes, washed and immersed in a 10% methane-sulphonic acid solution, are immersed in the catalytic solutions A, B, and C, respectively, for 5 minutes at 25° C.; they are then washed and immersed in a 10% solution of HCl for 3 minutes at 35° C. for the activation; subsequently they are washed and immersed in a solution for the electroless deposition of nickel, which solution has the following composition:

Nickel sulphate ($NiSO_4.H_2O$): 15 g/l
Tribasic sodium citrate: 20 g/l
Sodium hypophosphite ($NaH_2PO_2.H_2O$): 20 g/l
Ammonium hydroxide solution 32% ($NH_4OH$): 20 g/l
pH of the solution: 9.9

After a few minutes of immersion at the temperature of 20° C., the plates are uniformly and completely coated with a thin adherent conductive layer of nickel-phosphorus, which allows a successive electrolytic deposition of metals. The respective support frames, coated with baked plastisol, after the stage of chemical metallization are found perfectly clean and without any metal deposit.

It is to be understood that various modifications and substitutions by technically equivalent means may be applied to what has been described by way of example hereinabove, without departing from the scope of the invention as defined by the appended claims.

Having thus described my invention, what I claim is:

1. In a catalytic solution for the electroless deposition of metals onto electrically non conductive or only partially conductive supports, containing the products of mixing and reaction of at least one water-soluble salt of a noble metal of group IB or group VIII of the periodic system, at least one water-soluble salt of a metal of group IV of the periodic system, and an acid capable of forming stable complexes with said salts, the improvement that at least most of said acid is an aliphatic sulphonic acid having the general formula $RSO_3H$, where R is a linear or branched aliphatic group containing from 1 to 6 carbon atoms.

2. A solution according to claim 1, wherein the said aliphatic sulphonic acid is methane-sulphonic acid in such a concentration as to ensure the stability and catalytic activity of the solution resulting from the mixing and the reaction of the components.

3. A solution according to claim 1, wherein the said water soluble salt of a noble metal is a salt of a metal of the group of the platinum.

4. A solution according to claim 1, wherein the said water soluble salt of a noble metal is a salt of palladium.

5. A solution according to claim 1, wherein the said soluble salt of a noble metal is a palladium salt of an aliphatic sulphonic acid.

6. A solution according to claim 1, wherein the said soluble salt of a noble metal is methane-sulphonate palladium.

7. A solution according to claim 1, wherein the said soluble salt of a group IV metal is a water soluble stannous salt in molar excess relative to the salt of a noble metal.

8. A solution according to claim 1, wherein the said water-soluble salt of group IV metal is a stannous salt of an aliphatic sulphonic acid.

9. A solution according to claim 1, wherein the said water-soluble salt of group IV metal is stannous methane-sulphonate.

10. A solution according to claim 1, wherein the molar ratio between the water soluble salt of a noble metal and the water soluble salt of a group IV metal is from 1:5 to 1:100.

11. A solution according to claim 1, wherein the molar ratio between the soluble salt of a noble metal and the water soluble salt of a group IV metal is from 1:10 to 1:60.

12. A solution according to claim 1, wherein the concentration of the aliphatic sulphonic acid ranges between 0.1 g/l and the limit of solubility.

13. A solution according to claim 1, wherein the concentration of the aliphatic sulphonic acid ranges from 1 molar to 10 molar.

14. A solution according to claim 1, wherein the concentration of the salt of a noble metal ranges from 0.001 to 50 g/l.

15. A solution according to claim 1, wherein, the solution is concentrated and intended to be diluted for the use, the concentration of the salt of the noble metal ranges between 1 and 50 g/l.

16. A solution according to claim 1, wherein, the solution which is ready for use for the electroless deposition of a metal, has a concentration of the noble metal salt ranging from 0.001 to 1 g/l.

17. A solution according to claim 1, wherein halides are present as no more than as traces.

18. A solution according to claim 1, wherein free hydrochloric acid is present as no more than a trace.

19. A solution according to claim 1, wherein both halides and free hydrochloric acid are present as no more than traces.

20. A solution according to claim 1, which contains a water soluble salt of an alkali metal and of an aliphatic sulphonic acid.

21. A solution according to claim 1, which contains sodium methane-sulphonate.

22. A solution according to claim 1, which contains a water soluble salt of an alkali metal and an aliphatic sulphonic acid in a quantity between 1 g/l and the limit of solubility .

23. A solution according to claim 1, which further contains glycine in a concentration ranging from 0.1 to 25 g/l.

24. A solution according to claim 1, which contains the products of mixing and reaction of an aliphatic sulphonic acid with a water soluble salt of palladium and with a soluble stannous salt.

25. A solution according to claim 1, wherein said water-soluble salt of a group IV metal and said water-soluble salt of a noble metal contain halides, and the content of halides in the solution is not substantially higher than the total quantity of halides contained in said salts.

26. A solution according to claim 1, wherein said water-soluble salt of a group IV metal contains halides, and the content of halides in the solution is not substantially higher than the total quantity of halides contained in said salt.

27. A solution according to claim 1, wherein said water-soluble salt of a noble metal contains halides, and the content of halides in the solution is not substantially higher than the total quantity of halides contained in said salt.

28. A solution according to claim 1, comprising a concentrated solution and a diluting solution containing an aliphatic sulphonic acid, wherein said concentrated solution contains chlorine ions, and the content of chlorine ions in the diluting solution is not substantially higher than the quantity of chlorine ions contained in said concentrated solution.

29. A solution according to claim 1, which is substantially free from halides.

30. A solution according to claim 1, which is substantially free from free hydrochloric acid.

31. A solution according to claim 1, which is substantially free from halides and from free hydrochloric acid.

* * * * *